United States Patent [19]

Yukawa et al.

[11] Patent Number: 4,824,637

[45] Date of Patent: Apr. 25, 1989

[54] ALLOY PHASE STABILITY INDEX DIAGRAM

[76] Inventors: Natsuo Yukawa; Masahiko Morinaga, both of 2-1, Higarshiura, Kitayama-cho,, Toyohashi City, Aichi Pref., Japan

[21] Appl. No.: 147,047

[22] Filed: Jan. 22, 1988

Related U.S. Application Data

[63] Continuation of Ser. No. 843,061, Mar. 24, 1986, abandoned.

[30] Foreign Application Priority Data

Aug. 29, 1985 [JP] Japan ..... 60-190220

[51] Int. Cl.[4] ..... C22C 33/00

[52] U.S. Cl. ..... 420/129; 434/298

[58] Field of Search ..... 420/129; 434/298

[56] References Cited

U.S. PATENT DOCUMENTS 3,782,926 1/1974 Kirkpatrick et al. ..... 420/590 X 3,840,652 10/1974 Albers ..... 420/590 X

OTHER PUBLICATIONS

*Constitution of Binary Alloys, First Supplement,* by Rodney, P. Elliott, PhD. McGraw-Hill © 1965, Received 1982, pp. 438-439.

M. Morinaga et al., Alloying Effect on the Electronic Structure of $Ni_3Al$, J of the Physical Soc. of Japan, 53, 2 (1984, 2) pp. 653-663.

M. Morinaga et al., Solid Solubilities in Transition Metal-Based f.c.c. Alloys, Phil. Mag. A, 51, 2 (1985) pp. 223-246.

M. Morinaga et al., Solid Solubilities in Nickel-Based f.c.c. Alloys, Phil. Mag. A, 51, 2 (1985), pp. 247-252.

M. Morinaga, et al., New PHACOMP and its Application to Alloy Design, Superalloys 1984 (Proc. of the 5th Intern., Symp. on Superalloys, held Oct. 7-11, 1984, Seven Springs, Pa.) Metal Soc. of AIME, pp. 523-532.

N. Yukawa et al., New Approach to the Design of Superalloys (1985) Proc. of the 2nd Japan-U.S. Seminar on Superalloys, held Dec. 7-11, 1984, Susono-shi, Shizuoka-Pref., Japan Inst. Metals, 37-48.

Natsuo Yukawa, "New PHACOMP for Superalloys", 54, 4 (1983, 11) pp. 275-287.

Natsuo Yukawa: Strategy for Materials Design and Development, Chapt. 3, The d-Electrons Austenitic Alloy Design and New PHACOMP, Ed. Y. Mishima and S. Iwata, publ. by Soft Science Co., Ltd., 1985, 7, pp. 79-103.

Masahiko Morinaga et al., Cluster Theory for Calculating the Electronic Structure of Alloys and its Applications, 23, 11 (1984), pp. 911-919, Nippon Kinzoku Kaihou.

*Primary Examiner*—Peter D. Rosenberg

*Attorney, Agent, or Firm*—Silverman, Cass, Singer & Winburn, Ltd.

[57] ABSTRACT

An alloy phase stability index diagram comprising a phase distribution range specified therein by calculating average values $\overline{Md}$ and $\overline{Bo}$ of an alloy according to the following formulae with respect to an energy level of "d" orbitals of an alloying element and a bond order between a mother metal and an alloying element:

$$\overline{Md} = \Sigma Xi(Md)i \quad (1)$$

$$\overline{Bo} = \Sigma Xi(Bo)i \quad (2)$$

where Xi is an atomic fraction of the alloying element (i) and (Md)i and (Bo)i are the Md value and the Bo value, respectively, and by locating alloys with known compositions in the index diagram in which $\overline{Bo}$ or $\overline{Md}$ thus defined is taken in an ordinate or an abscissa or $\overline{Bo}$ and $\overline{Md}$ are taken in both the coordinates.

25 Claims, 12 Drawing Sheets

Ti-M (a)M=Mo (b)Fe (c)Cr (d)Mn (e)V (f)Co (g)Ni

ALLOY PHASE STABILITY INDEX DIAGRAM

This application is a continuation of application Ser. No. 843,061, filed Mar. 24, 1986, now abandoned

BACKGROUND OF THE INVENTION

1. Field of the Invention

The present invention relates to alloy phase-stability index diagrams for use in the evaluation of phase stability and properties of various alloys and quality control thereof.

2. Related Art Statement

In many cases, the evaluations of the phase stability of alloys has heretofore exclusively relied upon experiences, and has been carried out through numerous trial and error experiments and examinations. In general, phase diagrams of binary or ternary alloys obtained by such experiments or Schaeffler's diagrams applicable to the evaluation of a weld metal/deposit metal of austenitic stainless steel and cast iron, have been used as empirical index diagrams showing the phase stability.

It may be possible to deduce the phase stability by the same method as far as binary or ternary alloys with a relatively small amount of alloying element or impurities are concerned. However, it is impossible to deduce the phase stability of hypercomplex alloys containing a large number of alloying elements. Further, in such cases, a great expense and long time are necessary for the experimental evaluation of the phase stability and hence this is extremely inefficient. Furthermore, the inaccuracy accompanied with such evaluation causes serious problems in improving the reliability of the materials and attaining a high performance thereof.

SUMMARY OF THE INVENTION

It is an object of the present invention to provide alloy phase stability index diagrams with which the inexpensive production of alloys with excellent phase stability becomes possible.

It is another object of the present invention to provide a process for producing alloys with high phase stability in terms of such alloy stability index diagrams.

Having made various investigations to solve the above problems, the present inventors have found that an alloy phase stability index diagram is obtained by using (a) an energy level of "d" orbitals (hereafter referred to as Md) of an alloying element in a mother metal and/or (b) a bond order (hereafter referred to as Bo) representing the magnitude of the bond strength between the mother metal and the alloying element. Both Md and Bo are determined by calculating electronic structures of various alloys by using a molecular orbital method (Discrete-Variational (DV)-X$\alpha$ cluster method). Instead of several classical parameters such as metal radii, electronegativities, the average valence electron number per one atom (e/a) or the electron vacancy concentration (Nv), the phase stability of alloys can be evaluated by using new parameters and the alloy phase stability index diagram.

The present invention is based on the above investigation. The invention relates to alloy phase stability index diagrams characterized by new alloying parameters Md and Bo. The average $\overline{Md}$ and $\overline{Bo}$ of the alloy are determined by the following formulae:

$$\overline{Md} = \Sigma Xi(Md)i \quad (1)$$

$$\overline{Bo} = \Sigma Xi(Bo)i \quad (2)$$

Here, Xi is the atomic fraction of an element (i) in the alloy, and (Md)i and (Bo)i and Md value and Bo value of the element (i), respectively; this $\overline{Bo}$ or $\overline{Md}$ is plotted on an ordinate or an abscissa or $\overline{Bo}$ and $\overline{Md}$ are plotted on both the coordinates; and the locations of known commercial alloys are set on the diagram made by $\overline{Bo}$ and $\overline{Md}$, and this can be used to specify a phase stability range.

There is another aspect of the present invention, there is a provision of alloy phase stability index diagrams with which the phase stability and the other alloy properties are described by $\overline{Bo}$ and $\overline{Md}$.

These and other objects, features and advantages of the present invention will be well appreciated upon reading of the invention in connection with the attached drawings. Some modifications, variations, and changes could be easily done by a person skilled in the art to which the invention pertains without departing from the spirit of the invention or the scope of claims appended hereto.

BRIEF DESCRIPTION OF THE DRAWINGS

For the better understanding of the invention, reference is made to the attached drawings, wherein.

DETAILED DESCRIPTION OF THE INVENTION

The invention will be explained more in detail with reference to the attached drawings.

Figures 1A, 1B, 1C:
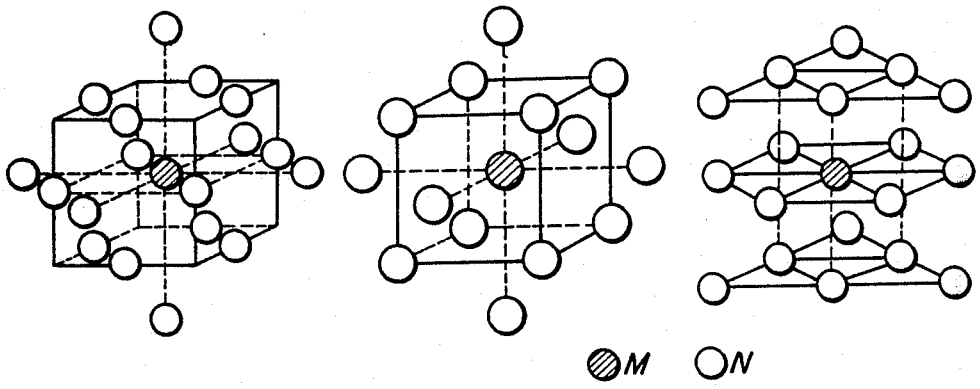
FIGS. 1(*a*), 1(*b*) and 1(*c*) are perspective views of the respective cluster models.

The DV-X$\alpha$ cluster method is a molecular orbital calculating method of electronic structures by using an aggregate (cluster) model consisting of from several to dozens of atoms. The cluster models used by the present inventors to calculate characteristic values of metals are shown in FIGS. 1(*a*), 1(*b*) and 1(*c*). FIGS. 1(*a*), 1(*b*) and 1(*c*) show the respective models of a face centered cubic lattice (fcc) $MN_{16}$ cluster, a body centered cubic lattice (bcc) $MN_{14}$ cluster, and a close packed hexagonal lattice (hcp) $MN_{16}$ cluster. N and M denote a mother element and an alloying element, respectively. Each of the models consists of the alloying element M located at its center and the mother elements N position in the first-nearest-neighbours and the second-nearest-neighbours from M.

The distance between atoms are set to the experimental value determined by the measurement of lattice constants. The electronic structure of the cluster (molecule) is self-consistently solved by using the Xα potential proposed by Slater. Different from the ordinary methods, when a secular equation is solved, matrix elements of Hamiltonians and overlap integrals are calculated at sampling points randomly selected in a space, and eigen values and eigen functions of electrons are determined.

In contrast to the band calculating method, the cluster method is suitable for examining the state of localized electrons. By use of the cluster models shown in FIGS. 1(*a*) to 1(*c*), the electronic state around an alloying element is examined and parameters showing the alloying effect, that is, the bond order (Bo) between the mother element and the alloying element and the "d" orbital level (Md) of the alloying element can be determined theoretically. In this case, new two electron energy levels of $e_g$ and $t_{2g}$, mostly originated from d orbitals of M, appear in the level structure. The average value of them is defined as Md. The bond order Bo is determined by calculating all the overlap integrals of the atomic orbitals between the mother element N and the alloying element M in the cluster in FIG. 1. In a multi-component alloy, the average values of Md and Bo are defined by taking compositional average following in the above-recited formulae (1) and (2), respectively.

In the present invention, $\overline{Md}$ or $\overline{Bo}$ is taken in an ordinate or an abscissa, or Bo and Md are taken in both the coordinates. Then, alloys with known compositions are positiond on these coordinates to specify a phase stability range. Further, the present invention is to provide alloy phase stability index diagrams made by $\overline{Md}$ and $\overline{Bo}$ parameters. According to these diagrams, the phase stability and the alloy characteristics can be described well, and hence these are useful for the design and development of alloys.

The invention will be well appreciated with reference to the following Examples, but they are given merely in illustration thereof and never interpreted to limit the scope thereof.

EXAMPLE 1

Evaluation of the phase stability of heat-resisting austenitic iron base alloys by the Md parameter In heat-resisting austenitic iron base alloys having a face centered cubic lattice (fcc), brittle TCP (topologically close-packed) phases such as the σ phase, occur during the use at high temperatures for a long time. The occurrence of these phases deteriorates mechanical properties, particularly, the toughness of the material and shortens the rupture life thereof. An electron vacancy concentration (Nv) has been used widely as a parameter for evaluating such a phase stability of austenitic alloys. This empirical evaluation method based on Nv has been called "PHACOMP" (an abbreviation of Phase Computation). The parameter used in this method is the number of the electron vacancies existing above the Fermi level in the d band of a pure metal. In the following, the superiority of the present invention will be shown in comparison with this empirical method.

Values of the parameters Md and Bo for the fcc lattice are listed in Table 1, which were obtained from the calculations using the cluster model of FIG. 1(*a*). For comparison, the conventionally used Nv values are also shown in Table 1.

TABLE 1

| Alloying element | | Md (ev) | Bo | Nv |
|---|---|---|---|---|
| | Al | 1.900 | 0.533 | 7.66 |
| | Si | 1.900 | 0.589 | 6.66 |
| 3d | Ti | 2.271 | 1.098 | 6.66 |
| | V | 1.543 | 1.141 | 5.66 |
| | Cr | 1.142 | 1.278 | 4.66 |
| | Mn | 0.957 | 1.001 | 3.66 |
| | Fe | 0.858 | 0.857 | 2.66 |
| | Co | 0.777 | 0.697 | 1.71 |
| | Ni | 0.717 | 0.514 | 0.66 |
| | Cu | 0.615 | 0.272 | — |
| 4d | Zr | 2.944 | 1.479 | 6.66 |
| | Nb | 2.117 | 1.594 | 5.66 |
| | Mo | 1.550 | 1.611 | 4.66 |
| 5d | Hf | 3.020 | 1.518 | 6.66 |
| | Ta | 2.224 | 1.670 | 5.66 |
| | W | 1.655 | 1.730 | 4.66 |
| | Re | 1.267 | 1.692 | 3.66 |

Figures 2A, 2B, 2C:
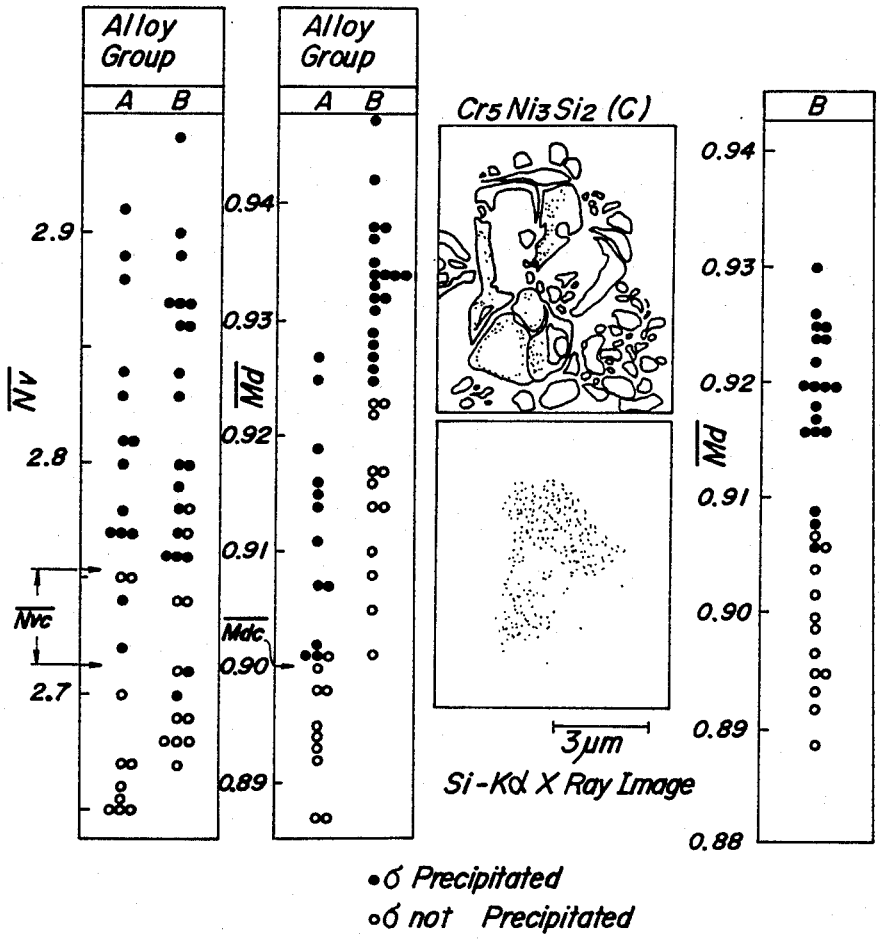
FIGS. 2(*a*), 2(*b*) and 2(*c*) are phase stability index diagrams regarding the occurrence of a $\sigma$ phase in HK-40.

FIG. 2 is a phase stability index diagram of the experimentally prepared heat-resisting iron base HK-40 alloys shown in Table 2(a). These alloys were cold rolled by 40% and then aged at 800° C. for 15,000 hours. The occurrence of the σ phase was examined metallographically. a total of 54 alloys were divided into the σ-prone (●) or σ-free (○) type from the experiment, and the results are shown in FIG. 2(*a*) $\overline{Nv}$ and (*b*) $\overline{Md}$. In table 2, $\overline{Nv}$ is a compositional average of Nv obtained by using a similar formula (1) or (2). As shown in Table 2(b), from the Si content the alloys are classified into the two groups. Namely, the alloys in the group A contain a smaller amount of Si, while those in the group B contain a larger amount thereof. As is obvious from FIG. 2(*b*), the group A has a precipitation limit of the σ phase at the $\overline{Md}$ of about 0.900. The present inventors have determined such a critical value $\overline{Md}_c$ for the occurrence of the σ phase in the austenitic (γ) phase, from the systematic examination of the γ/γ+σ phase boundary in various binary or ternary phase diagrams, and confirmed that it is expressed by the following formula.

$$\overline{Md}_c = 6.25\times10^{-5}T + 0.834 \quad (3)$$

where T is an absolute temperature (K).

TABLE 2(a)

| | Composition of HK-40 alloys (wt %) | | | | | | |
|---|---|---|---|---|---|---|---|
| | C | Si | Mn | Cr | Ni | Fe | Total number of alloys |
| Sample | 0.02~0.63 | 0.05~2.16 | 0.05~2.95 | 15.23~31.55 | 18.76~31.56 | balance | 54 |

TABLE 2(b)

| Alloy group | Composition of HK-40 alloys (wt %) C | Si | Mn | Cr | Ni | Fe | Number of each alloy group |
|---|---|---|---|---|---|---|---|
| A | 0.02~0.59 | 0.05~0.98 | 0.05~2.95 | 22.87~25.37 | 18.76~22.63 | balance | 22 |
| B | 0.08~0.63 | 1.49~2.16 | 0.93~1.13 | 15.23~31.55 | 19.25~31.50 | balance | 21 |

TABLE 2(c)

| Composition of HK-40 alloys (wt %) ASTM Standard C | Si | Mn | P | S | Ni | Cr | Fe |
|---|---|---|---|---|---|---|---|
| 0.35~0.45 | <1.75 | <1.50 | <0.04 | <0.04 | 19.00~22.00 | 23.00~27.00 | balance |

The critical value of 0.900 (eV) (hereafter the unit, eV, is omitted for simplicity) for the $\sigma$ phase formation in the group A, agrees with the calculated value from the formula (3) at 800° C. On the other hand, the alloys in the group B has the precipitation limit at about 0.925. This discrepancy is due to the fact that a high Si compound of $Cr_5Ni_3Si_2(C)$ shown in an SEM photogrpah of FIG. 2 occurs in the high Si alloys. If the existence of this compound is taken into account, as shown in FIG. 2(*c*), the $\sigma$ phase precipitation limit $\overline{Md}_c$ decreases near 0.90, and becomes the substantially sa,e critical value as that of the groups A. On the other hand, the $\sigma$ phase precipitation boundary is scattered in the Nv of FIG. 2(*a*), and no clear difference is observed between the group A and the group B. Thus, the existence of the Si compound in the group B can not be predicted by the Nv method.

EXAMPLE 2

Figure 3:
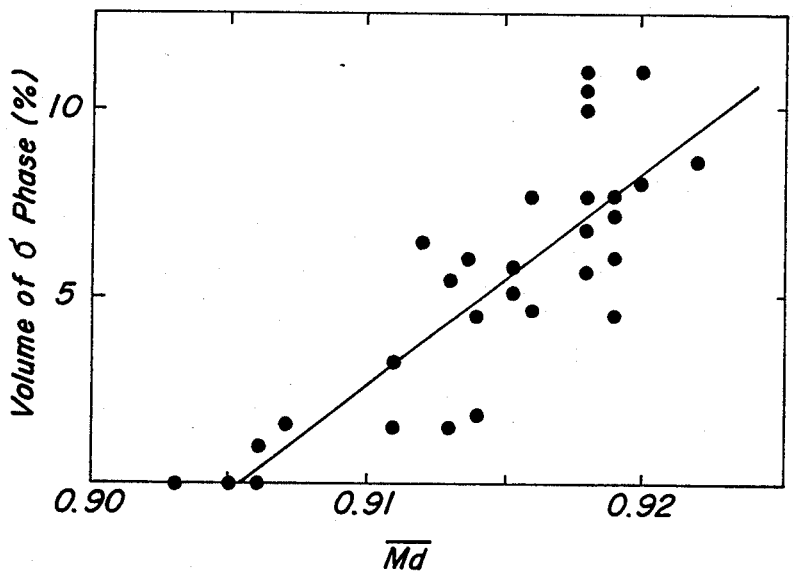
FIG. 3 is a phase stability index diagram regarding the occurrence of the $\sigma$ phase in HK-40 actually used at 800°–850° C. for 35,000–80,000 hours.

Evaluation of the phase stability of heat-resisting austenitic iron base alloys by the Md parameter FIG. 3 is a phase stability index diagram in which volume percent data of the $\sigma$ phase formed in HK-40 alloys after actual use as a heat exchanger in a vapor reformer at the temperatures of 800° to 850° C. for 35,000 to 80,000 hours are plotted with respect to $\overline{Md}$. In this case, alloy compositions are controlled to be within the standard specification (see FIG. 2(*c*)). It is preferable from the standpoint of a prolonged life of the apparatus that no $\sigma$ phase occurs in alloys. The $\overline{Md}$ values of the used alloys fall between 0.903 and 0.922. From FIG. 3, the critical Md value for the occurrence of the $\sigma$ phase is found to be 0.905 which accords approximately with a value of 0.90 at 800° C. determined from the formula (3). Thus, it has been proved that the alloy composition of KH-40 used in such an apparatus should be selected so that $Md \leqq 0.905$. The calculations in Examples 1 and 2 are performed presuming experimental facts that all C contained in the alloy constitutes a $Cr_{23}C_6$ phase. The residual composition of the $\gamma$ phase is then determined and used for the evaluation of the phase stability shown in FIG. 3.

EXAMPLE 3

Evaluation of the stacking fault energy of Fe-Ni-Cr system alloys by the Md parameter The stacking fault energy of the austenitic (fcc) alloys is an important physical parameter dominating the work-hardening, creep strength at high temperatures and so on.

When the stacking faults appear at a (111) plane of a fcc metal, the atomic arrangement of the stacking fault region becomes similar to that in a hcp metal. Therefore, the Md is used for the evaluation of the stacking fault energy, by considering that the stability of fcc phase is associated with the appearance of the hcp phase (i.e. stacking fault).

Figure 4:
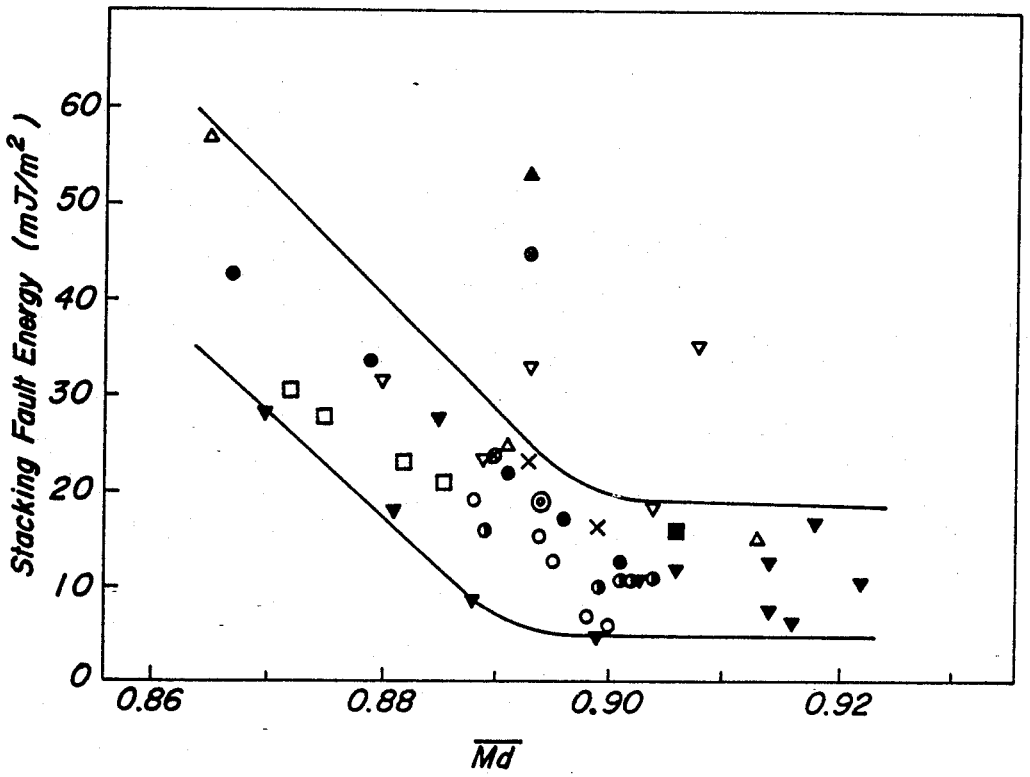
FIG. 4 is a diagram to evaluate the stacking fault energy of Fe-Ni-Cr system alloys in terms of Md.

In FIG. 4, stacking fault energies, determined by a node method or a weak beam method of the electron microscope are plotted against $\overline{Md}$. Except for a few data, stacking fault energies fall in a narrow band. "◑" marks are due to the data recently determined by the weak beam method, and they are located substantially in the central portion of the band.

With increasing $\overline{Md}$, the stacking fault energy decreases until $\overline{Md}$ reaches 0.90 and remains substantially constant thereafter. It has been found that commercial stainless steel SUS 304 and 316 have the $\overline{Md}$ of about 0.90, and hence have the lowest stacking fault energy among the Fe-Ni-Cr system alloys. By using a formula (1) and FIG. 4, the stacking fault energy values can be determined from the alloy compositions without performing any troublesome experiments.

EXAMPLE 4

Evaluation of the phase stability of heat-resisting nickel base single crystal superalloys by the Md parameter In heat-resisting nickel base single crystal superalloys, there are no grain boundaries at which fracture initiates during the use at high temperatures. Recently developed superalloys contain as much as about 55 to 67 volumeric % of the $\gamma'$ ($Ni_3Al$) phase dispersed in the $\gamma$ (fcc) matrix phase. Thus, because of their extremely high strength at higher temperature, superalloys are used for the blades and vanes of jet engines.

When a single crystal is grown by the one directional solidification method, the alloy sometimes contains a few volumetric % of the eutectic $\gamma'$ phase, as the result of an eutectic reaction of L and $\gamma+\gamma'$ (L: a melt). If such an eutectic phase remains even after the solution treatment near about 1,300° C., the boundary of the massive eutectic $\gamma'$ phase becomes a crack initiation site, resulting in the deterioration of the high-temperature strength of alloys. Therefor, it is necessary that alloys should be designed so that the eutectic $\gamma'$ phase almost disappears by the solution treatment. In the other words, the composition of the practical alloys should be adjusted following this point.

Further, if the TCP phase such as the $\sigma$ or $\mu$ phase occurs in the $\gamma$ matrix phase during the service of alloys for a long period, the endurance against creep rupture and the toughness are lowered. Thus, the phase stability of the alloy is extremely important.

Figure 5:
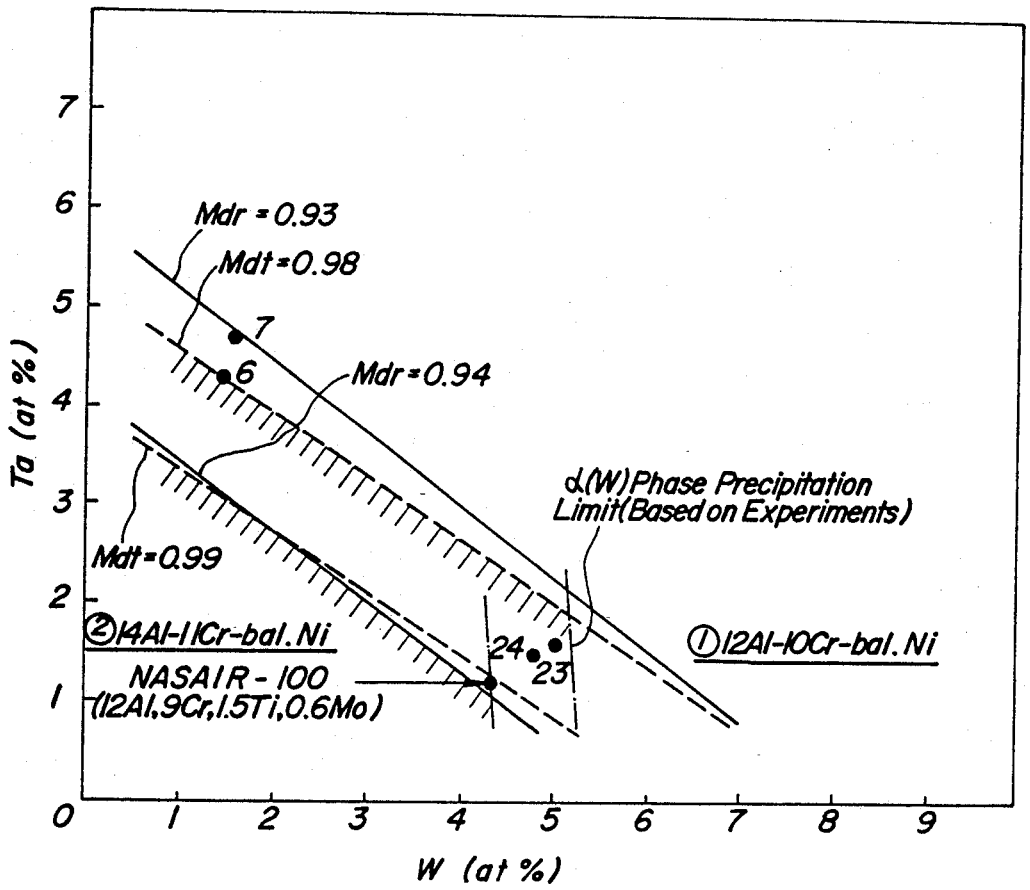
FIG. 5 is a phase stability index diagram regarding the production of heat-resisting nickel base single crystal superalloys.

FIG. 5 is an index diagram showing the phase stability of the two alloys systems of (1) 12 at % Al-10 at %

Cr-Ta-@-balance Ni and (2) 14 at % Al-11 at % Cr-Ta-W-balance Ni. In the figure, Ta and W contacts are taken in both coordinates. A composition which renders the eutectuic $\gamma'$ phase to be almost 0 volumetric % by applying the above solution treatment can be estimated by $\overline{Md}_t$ (the average $\overline{Md}$ value calculated from the alloy composition (at %)). The $\overline{Md}_t$ values are 0.98 for alloy (1) and 0.99 for alloy (2). On the other hand, the precipitation limit of a brittle phase (i.e. the $\sigma$ or $\mu$ phase) can be expressed by $\overline{Md}_\gamma$ (the average $\overline{Md}$ value calculated from the composition of the $\gamma$ phase (at %)). The critical $\overline{Md}_\gamma$ are 0.93 for alloy (1) and 0.94 for alloy (2). Besides these, $\alpha$ (bcc) phase mainly consisting of W precipitates on the high W side. The appearance of this phase also decreases the creep rupture life and the toughness. This limit has been experimentally confirmed, and are shown by a one-dot-chain line.

Taken into account these criteria, the regions of the limit compositions which can be selected in the alloys (1) and (2) are shown by shadow in FIG. 5. Table 3 is the result of the creep rupture test for the alloys which were chosen on the basis of this phase stability index diagram. For comparison, a commercial single crystal superalloy, NASAIR-100 alloy, was selected, and its composition is given in Table 3 together with the compositions of test alloys. Their compositions are indicated in FIG. 5. For these alloys, single crystals were prepared and subjected to the heat treatment shown under the Table. Then, the creep rupture test was performed using round bar test pieces of 4 mm in diameter and 30 mm in length between gauges under the conditions of the temperature of 1,040° C. and the stress of 14 kg/mm$^2$. Resulting creep rupture lives are shown in Table 3. Although the aging treatment was slightly varied, TUT-23 with the composition near the limit in (1) exhibited an extremely long creep rupture life as compared with the NASAIR-100 alloy. From the comparison between TUT 6 and TUT 7, it was found that TUT 6 with the composition near the limit has a rupture life of about 25% longer than TUT 7.

TABLE 3

| Alloy | Composition (atom %) of nickel base single crystal super heat-resisting alloy and creep rupture life | | | | | | | Creep rupture life | Aging treatments |
|---|---|---|---|---|---|---|---|---|---|
| | Al | Cr | Ni | Ta | W | Ti | Mo | | |
| NASAIR 100 | 12.24 | 9.88 | 71.26 | 1.11 | 3.46 | 1.42 | 0.63 | 377.4 | $T_1$ |
| TUT-23 | 12.00 | 10.00 | 71.48 | 1.50 | 5.02 | — | — | 1,681 | $T_2$ |
| TUT-24 | 12.00 | 10.00 | 72.05 | 1.38 | 4.57 | — | — | 917 | $T_1$ |
| TUT-6 | 12.00 | 10.00 | 72.00 | 4.50 | 1.50 | — | — | 230 | $T_1$ |
| TUT-7 | 12.00 | 10.00 | 71.63 | 4.78 | 1.59 | — | — | 178 | $T_1$ |

Solution treatment: 1,300° C. × 4 hr, air cooling
Aging treatment:
$T_1$ . . . 982° C. × 5 hr + 871° C. × 32 hr air cooling
$T_2$ . . . 1,050° C. × 16 hr + 850° C. × 48 hr air cooling
Creep rupture test:
Temperature . . . 1,040° C.
Stress . . . 14 kg/mm$^2$

EXAMPLE 5

Evaluation of the phase stability of titanium alloys by the Bo and Md parameters Titanium (Ti) has allotropes of $\alpha$ (hcp lattice) phase at low temperatures and $\beta$ (bcc lattice) phase at high temperatures. According to the existing phases, titanium alloys are classified into the three kinds of $\alpha$, $\beta$ and $\alpha+\beta$. Calculations of electronic structures were performed using both the bcc and hcp clusters shown in FIGS. 1(*b*) and (*c*), and Bo and Md pertinent to titanium alloys were determined. Since a large difference was not observed between the bcc and hcp phases, Bo and Md values determined for the $\beta$ (bcc) phase were used in the following phase stability index diagram.

Figure 6:
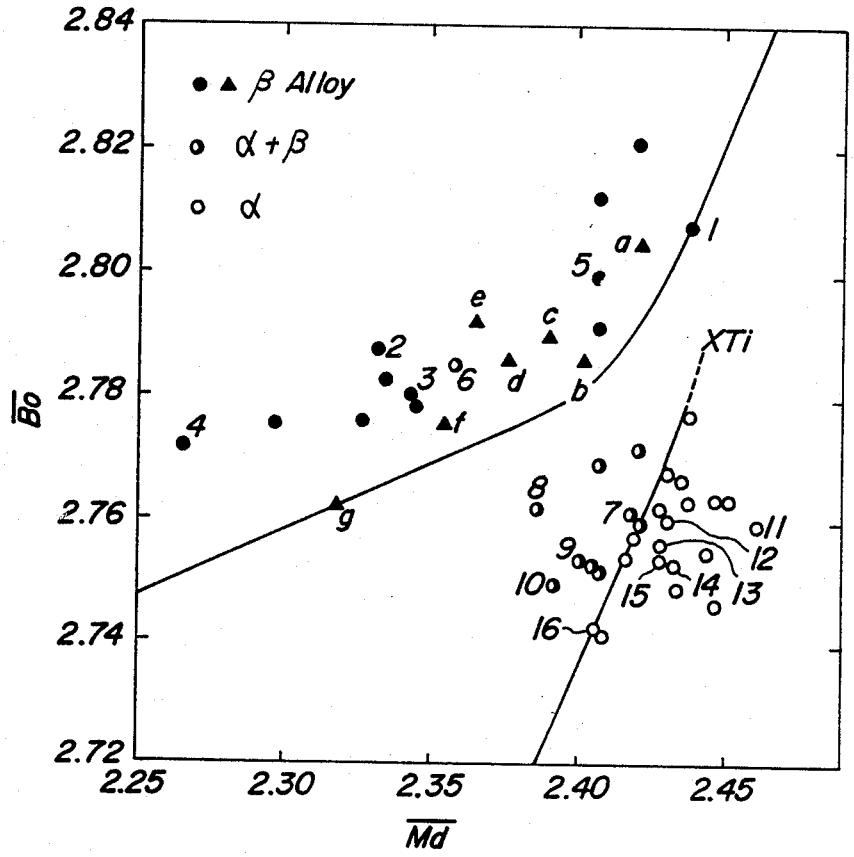
FIG. 6 is a phase stability index diagram for titanium alloys.

FIG. 6 is a phase stability index diagram in which the $\overline{Bo}$ and $\overline{Md}$ calculated from the composition by using the formulae (1) and (2) are taken in an ordinate and an abscissa, respectively. The locations of about forty commercial titanium alloys are shown by marks on this diagram. Among them, sixteen important alloys (alloy No. 1–16 in FIG. 6) have the following compositions.

| No. | Composition |
|---|---|
| 1 | Ti—4.5 Sn—11.5 Mo—6 Zr(Beta III) |
| 2 | Ti—3 Al—8 V—4 Zr—4 Mo—6 Cr(Beta C) |
| 3 | Ti—3 Al—8 V—8 Mo—2 Fe(8-8-2-3) |
| 4 | Ti—3 Al—13 V—11 Cr(13-11-3) |
| 5 | Ti—15 Mo—5 Zr—3 Al |
| 6 | Ti—8 Mn(8 Mn) |
| 7 | Ti—6 Al—6 Mo—2 Sn—4 Zr(6-2-4-6) |
| 8 | Ti—5 Al—2 Sn—2 Zr—4 Mo—4 Cr(Ti—17) |
| 9 | Ti—6 Al—4 V(6-4) |
| 10 | Ti—6 Al—6 V—2 Sn(6-6-2) |
| 11 | Ti—2.25 Al—11 Sn—5 Zr—1 Mo—0.2 Si(IMI-679) |
| 12 | Ti—6 Al—0.5 Mo—5 Zr—0.2 Si(IMI685) |
| 13 | Ti—6 Al—2 Mo—2 Sn—4 Zr(6-2-4-2) |
| 14 | Ti—5 Al—6 Sn—2 Zr—1 Mo—0.2 Si(IMI-829) |
| 15 | Ti—5 Al—2.5 Sn(A—110) |
| 16 | Ti—8 Al—1 V—1 Mo(8-1-1) |

Here, numerals attached to each element symbol show the composition in the weight percent. In FIG. 6, according to the $\alpha$, $\alpha+\beta$ and $\beta$ types, commercial alloys are clearly separated in three different regions of the $\overline{Bo}$-$\overline{Md}$ diagram. ti-8 Mn alloy of No. 6 in the vicinity of $\overline{Md}=2.35$ and $\overline{Bo}=2.78$ is an $\alpha+\beta$ alloy, but appears in the $\beta$ region. This is, however, not in contradiction to the evaluation, this alloy essentially belongs to the $\beta$-type alloy, but his is heat-treated at an $\alpha+\beta$ temperature range to improve mechanical properties, and is conveniently grouped in the $(\alpha+\beta)$ type.

Figure 7:
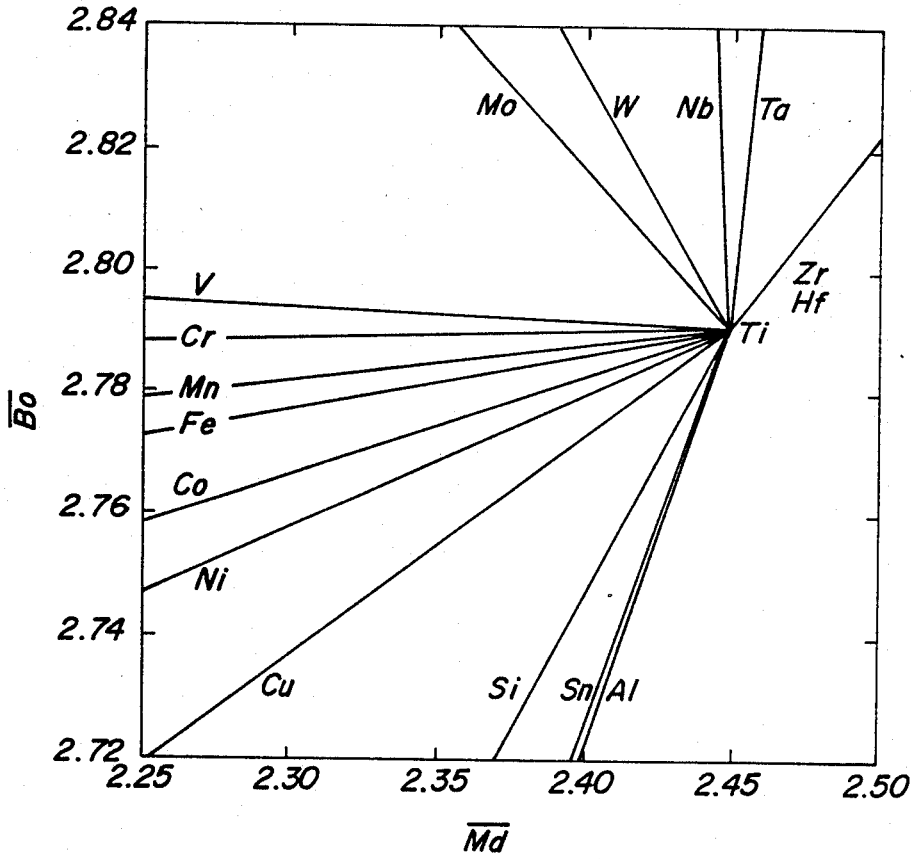
FIG. 7 is a diagram showing effects of alloying elements upon the phase stability of titanium alloys.

FIG. 7 shows in which direction the phase stability of the alloy shifts on the index diagram of $\overline{Bo}$-$\overline{Md}$ when an alloying element shown in the figure is added to Ti. For instance, when Mo or W is added, the phase stability moves left and upward from the location of Ti, while when Al or Sn is added, it moves left and downward, namely to the $\alpha$ phase region in FIG. 6. $\overline{Bo}$-$\overline{Md}$ is also related to the mechanical properties and the other physical properties of the alloy. Therefore, how much, and which alloying element is to be added, (that is, the so-called alloy design) and how the alloy properties change by the addition of other elements such as impurities can be grasped by comparing FIG. 6 with FIG. 7. In this sense, these diagrams are available for controlling the material quality.

The $\alpha$ (hcp) phase is inferior in the plastic workability to $\beta$ (bcc) phase. Thus, hot working is performed at temperatures of the $\beta$ phase region or near the $\beta+\alpha$ phase boundary in the production of the titanium alloys. This temperature of the transformation between the $\beta$ phase and $\alpha+\beta$ phase is called $\beta$-transus temperature. Only the $\beta$ phase is present at temperatures higher than this temperture. In addition to the hot-working, this $\beta$-transus temperature is extremely important in controlling the microstructure of Ti: alloys by the thermal treatments.

Figure 8:
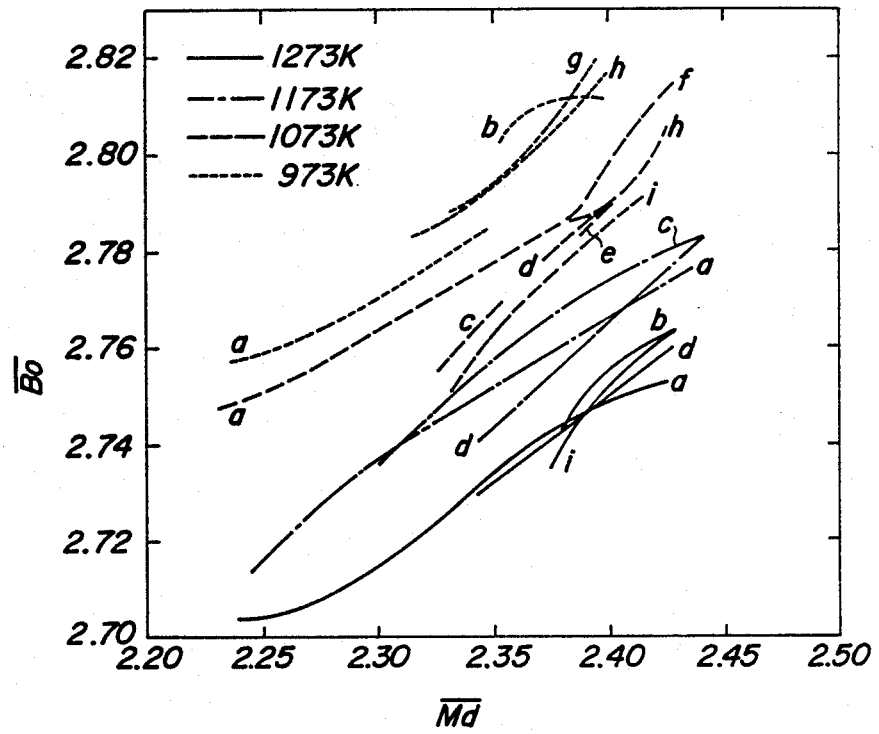
FIG. 8 is a diagram showing the $\beta$-transus curve of ternary Ti-alloy.

With respect to the following ternary Ti alloys (a) Ti-Al-Mn, (b) Ti-Al-Mo, (c) Ti-Al-Ni, (d) Ti-Al-V, (E) Ti-Cr-Fe, (f) Ti-Cr-W, (g) Ti-Mo-Cr, (h) Ti-Mo-Mn and (i) Ti-Al-Cr, their $\beta$-transus was traced in terms of $\overline{Bo}$ and $\overline{Md}$, and the results are shown in FIG. 8. Irrespective of the alloy systems, curves with a constant transus (973) to 1,274K) are substantially on the same $\overline{Bo}$-$\overline{Md}$ line. This suggests that both $\overline{Bo}$ and $\overline{Md}$ are important parameters for describing the phase stability of $\beta$ (bcc) Ti alloys.

Figure 9:
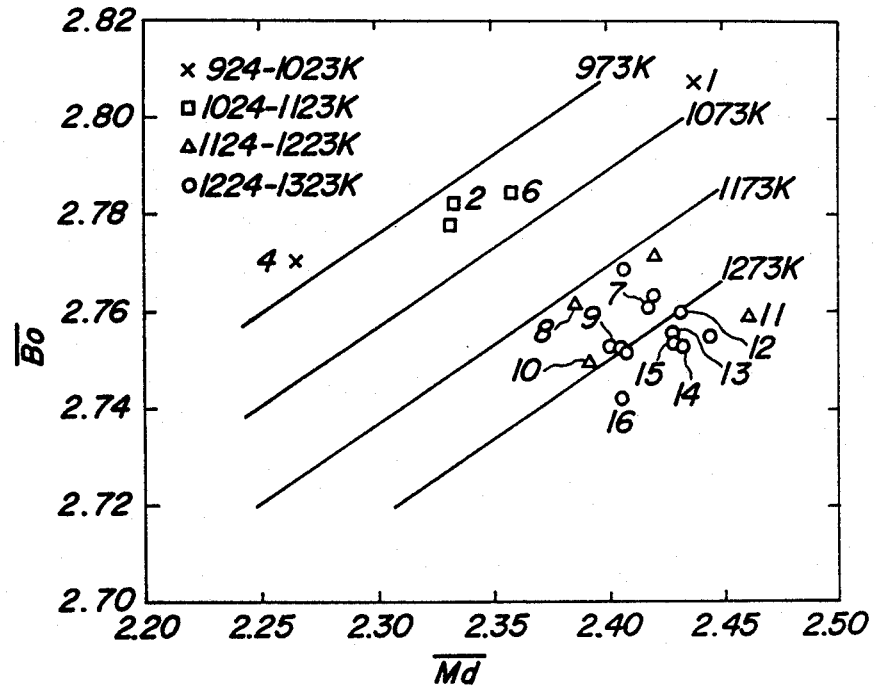
FIG. 9 is a phase stability index diagram showing $\beta$-transus temperatures of titanium alloys.

As shown in FIG. 9, four straight lines are drawn at the same interval by approximating the $\beta$-transus curves of each temperature by a straight line. In this figure, $\beta$-transus of the practical alloys is also plotted. In FIG. 9, alloy numbers are the same ones as shown in FIG. 6. For instance, the $\beta$-transus of Ti-6Al-4V (No. 9) is about 1.260K and shown by the "o" symbol (a range of 1,224 to 1,323K). The approximate formula, $\overline{Bo}=0.326\overline{Md}-1.95\times10^{-4}T+2.217$, is satisfied among the $\beta$-transus T(K), $\overline{Bo}$ and $\overline{Md}$. The measured $\beta$-transus well agrees with the calculated one.

Further, when Ti alloys are quenched from the $\beta$-phase range, the martensitic transformation takes place. The compositional dependency of the martensitic transformation-starting temperature (Ms) can be represented by the $\overline{Bo}$-$\overline{Md}$ index diagram as in the case of the $\beta$-transus. In addition, when the metastable $\beta$-phase is heated at about 400° C. or when the alloy is worked, the omega phase transformation takes place and some alloys become extremely brittle depending upon the compositions. Such a phase instability also can be explained by using the above index diagram.

As mentioned in the foregoing, various phase stabilities can be represented by using the index diagram drawn by taking $\overline{Bo}$ and $\overline{Md}$ on both the coordinates.

Moreover, alloys are required to have a low density but a high strength, for instance, Ti alloys used in space technology and the aircraft can be selected from the bond order (Bo) or the specific bond order (Bo/atomic weight).

Figure 10:
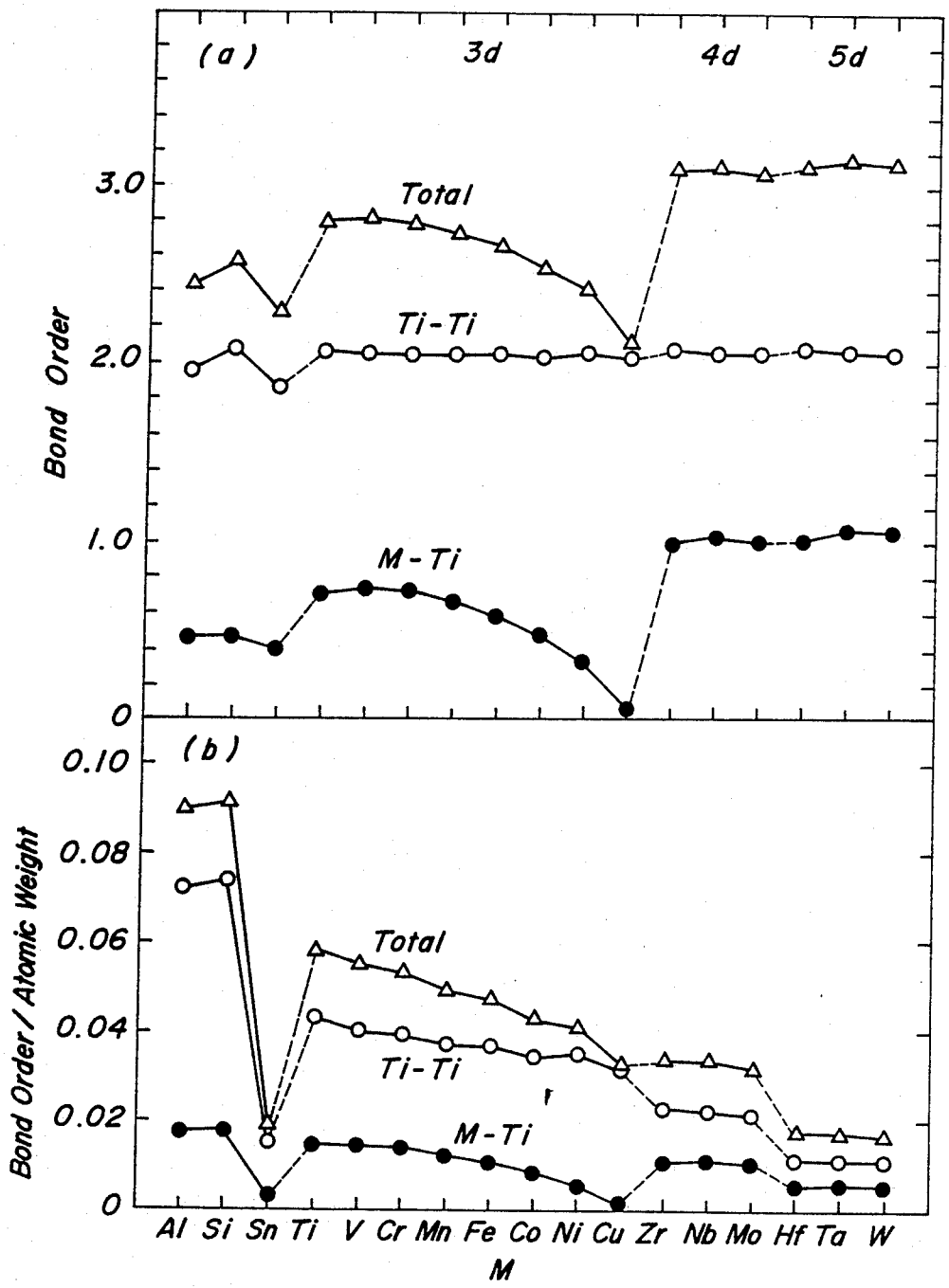
FIG. 10 is a phase stability index diagram showing (a) Bo and (b) Bo/atomic weight of Ti alloys.

FIG. 10 is an index diagram in which either Bo (a) or Bo/atomic weight (b) is taken in an ordinate, and comparison is made among various alloying elements. For instance, when viewed from the total value of the Bo/atomic weight in the lower column, Al and V, both of which are alloying elements in the most typical titanium alloy Ti-6Al-4V, show remarkably high values. Alloying elements can be selected based on FIG. 10 together with the above-mentioned $\overline{Bo}$-$\overline{Md}$ index diagram to make development or the quality control of the alloys.

Furthermore, the activating energy for the diffusion of the transition metal impurities in B-Ti can be evaluated accurately by using Bo.

EXAMPLE 6

Figure 11:
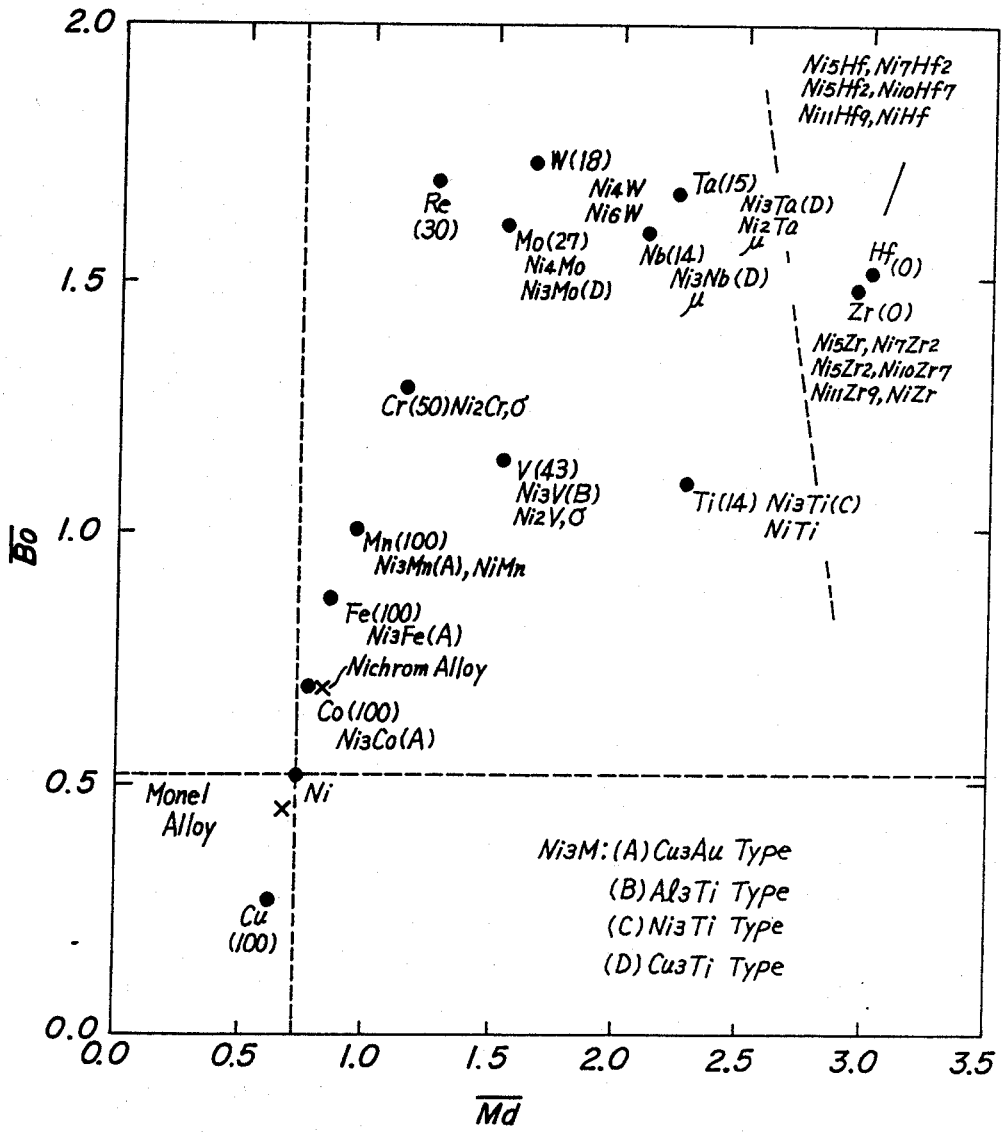
FIG. 11 is a phase stability index diagram of nickel base binary alloys.

Index diagram of the phase stability of nickel base binary alloys by using Bo and Md parameters FIG. 11 is an index diagram for showing the phase stability of nickel base Ni-M binary alloys. In the figure, "●" marks are given by plotting Bo and Md values for M in Table 1. Numerals in the parentheses are the maximum solid solubility limits of an element in the austenite ($\gamma$) phase of Ni-M binary alloys. Also, the names of intermetallic compounds appearing in the Ni-M systems are shown in FIG. 11.

The maximum solid solubility limits show the same values approximately along a broken line in the figure, and are zero in the case of Hf and Zr both having high Bo and Md. When the alloy composition approaches Ni, the maximum solid solubility limit becomes 100%, indicating that a complete solid solution is formed. For Cu with low Bo and Md, a complete solid solution is also formed. The study of the magnetic properties suggests the existence of the clusters of Ni-Ni and Cu-Cu. Thus, in the case of the alloy with the low Bo, there occurs the tendency of the two phase separation.

Next, the elements with higher Bo and MD than Ni form the ordered lattice or compound of $Ni_3M$ type excluding Hf and Zr. It is the of $Cu_3Au$ type ((A) type) for the elements in the vicinity of Ni. As the position moves right upwardly in the diagram, it is converted into (C)-(D) type having a more complex crystal structure. However, irrespective of any crystal form, one M is surrounded by twelve Ni elements. As the bond strength of Ni-M becomes stronger (Bo becomes larger), a more complex $Ni_3M$ type compound is formed. Any of the (A)-(D) type $Ni_3M$ compounds is the GCP (Geometrically Close-Packed) phase. The TCP phase such as the $\sigma$ and the $\mu$ phase appears in the case of elements having high Bo and Md. Further, Hf and Zr form numerous intermetallic compounds. These compounds are stable in an extremely narrow compositional range, and called line compounds.

In FIG. 11 are shown $\overline{Bo}$-$\overline{Md}$ locations of two commercial alloys, that is, (1) Monel alloy (Ni-30 wt % Cu) and (2) nichrome alloy (Ni-20 wt % Cr). By plotting in this way, the phase stability of any alloys can be understood from FIG. 11. For instance, when a certain meal element M is added to Ni, the phase stability of the alloy varies on a line connecting a point of Ni and a point of this M. Even in the case when the alloy becomes multicomponents by adding various elements simultaneously, the phase stability of the alloy varies in the direction of a synthesized vector which is the sum of the component vectors made by connecting the point of each alloys element with the Ni point, and the location of the phase stability thereof can be shown by the formulae (1) and (2). This is the same as described in Example 5.

EXAMPLE 7

Figure 12:
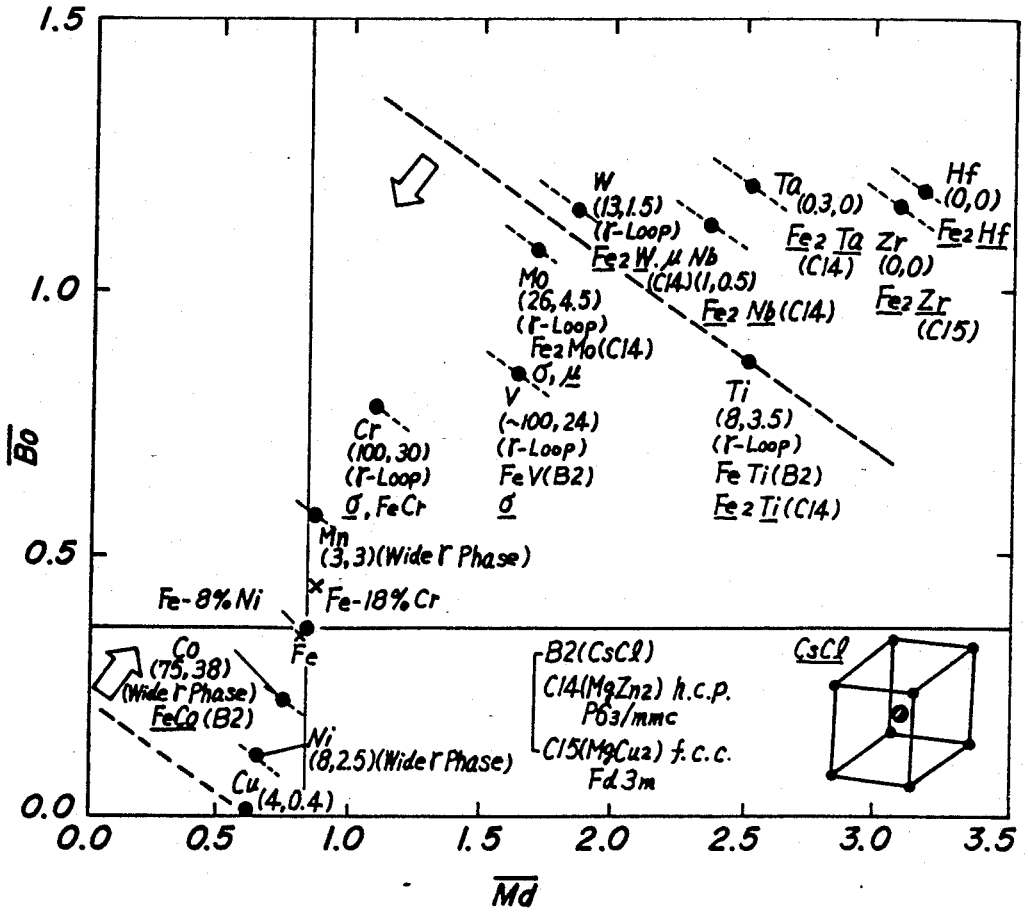
FIG. 12 is a phase stability index diagram of iron base binary alloys.

Index diagrams of the phase stability of iron base binary alloys by using Bo and Md parameters Similar to Example 6, an index diagram of iron base binary alloys is shown in FIG. 12. In FIG. 12, hcp and fcc denote "close packed hexagonal" and "face centered cubic", respectively. The calculation of electronic structure was made by using the cluster of the body centered cubic (bcc) lattic in FIG. 1(*b*). Similar to FIG. 11, "●" marks in FIG. 12 are plotted by using the calculated Bo and Md values for the respective M. The first number in the parenthesis for each element is its maximum solid solubility limit in the ferrite (bcc) phase of Fe-M binary alloys, and the latter is a solubility limit at 700° C. The solubilities at 700° C. are nearly constant along a broken line, and gradually increase in an arrow direction. For the Fe-Cu system having low Bo and Md, the phase separation takes place and two phases of $\epsilon$-Cu(fcc) and $\alpha$-Fe(bcc) appear at low temperatures. This separation probably arises from the strong interaction of the Cu-Cu pair and Fe-Fe pair as is the case of the Ni-Cu system.

The formation tendency of the compounds and ordered lattices (B2 (CsCl structure) in this case) is classified depending upon the locations of elements in the Bo-Md diagram. FIG. 12 shows the locations of a stainless steel Fe-18% Cr alloy and a low temperature steel, Fe-9% Ni alloy. The phase stability of the ferrite commercial alloys can be represented by this diagram as is found in the Ni-M system.

As mentioned above, the stability of the metal materials can be accurately represented by the phase stability index diagram according to the present invention. The phase stability influences upon the mechanical properties as well as the physical properties and the chemical properties of the materials. It has been a common way that the alloying effects upon one or more of these properties are investigated through experiments for the development of the metal materials and for the control of the quality and the properties, and optimum alloy compositions are determined based on these data. This process requires huge cost, labor and time, and is extremely inefficient. Particularly, it is extremely difficult to carry out such a process for the multi-components alloys. Further, when alloys whose experimental data are few to date (for instance, V), are intended to be developed, more tremendous research, development, and investment are required. Even in such a case, the Bo and Md of the alloying element M can be preliminarily determined for the mother metal of interest through theoretical calculations. Then, the ranges of the phase stability or unstability are predicted readily by using the phase stability index diagram, and experiments are performed with the candidate alloys in a very restricted compositional range. Thereby, the cost, labor and time can be reduced to a larger extent that before.

In commercial metal materials, the upper and lower contents of each component are generally determined according to a standard specification. However, from a standpoint of the practical application, it is extremely important to know what amount of an alloying element is optimum within the standard specification or to what extent an element (e.g. impurities) not specified in the standard is allowable when the material is produced or used. These factors can be totally determined by using the index diagram to show the change of $\overline{Bo}$ and/or $\overline{Md}$ with the amounts of the respective elements. By means of the index diagram, a fixed standard can be set for the quality control. For instance, this can be used for a prevention against the formation of brittle phases in heat-resisting alloys. In this case, the phase stability and the formation tendency of brittle phases can be totally predicted by using $\overline{Bo}$, $\overline{Md}$ index diagram. This prediction is applicable even to the multi-component system. This is one of great advantages in the present invention, since the available data on the phase stability is very limited for the multi-component systems. For instance, most of the conventional alloy phase diagrams are binary and ternary systems, and the combination of alloying elements and the mother metal so far studied is so limited. Further, as seen in examples of the Ti alloys in Example 5, various information on the alloy state such as the microstructure, $\beta$-transus and the onset temperatures of martensitic transformation is associated with $\overline{Bo}$ and $\overline{Md}$ parameters. Thus, it is concluded that the phase stability and the other related properties of the multi-component alloys can be evaluated consistently.

When a new alloy is produced in the way that, a rare metal or a precious metal is substituted for other less-expensive metal, (for instance, Co substitution for Ni, or Ni substitution for Mn), an optimum composition of constituent elements can be determined by utilizing the index diagram developed in the present invention, so that the same phase stability as in the conventional alloy can be maintained. Thus, not only labor and time necessary for the research and development can be reduced, but also superior alloys can be produced at a relatively low cost. Therefore, the economical effect as well as the source saving effect are great.

What is claimed is:

1. A process for producing an alloy having a mother metal and at least one alloying element (1), . . . (i) and having a phase stability being free from the precipitation of second phases which deteriorate alloy properties which comprises:

calculating an average value Bo of an alloy according to the following formula:

$$\overline{Bo} = \sum_{k=1}^{i} Xk\,(Bo)k \qquad (2)$$

wherein Xk is an atomic fraction of an alloying element (k), (Bo)k is a bond order between a mother metal and said alloying element (Bo)k, and k is 1, 2, . . . , i;

preparing an alloy phase stability index diagram of said alloy with known compositions of said mother metal and said alloying elements (1), . . . (i), said diagram having two axes corresponding to an ordinate and an abscissa in which said $\overline{Bo}$ thus defined is taken along a first axis and a property of said alloy is taken along a second axis; and preparing said alloy having such amounts of said alloying elements as determined from said alloy phase stability index diagram.

2. The process for producing an alloy as defined in claim 1, wherein said alloy is selected from the group consisting of a Ni-based alloy, a Co-based alloy, and a Fe-based alloy.

3. The process for producing an alloy as defined in claim 1, wherein said alloy is a multi-component system having said mother metal and at least two said alloying elements.

4. The process for producing an alloy as defined in claim 1, wherein said alloy is a Fe-Ni-Cr system.

5. The process for producing an alloy as defined in claim 1, wherein said alloy is a Ni-based single crystal superalloy.

6. The process for producing an alloy as defined in claim 1, wherein said property of said alloy is a measure of a brittle TCP $\sigma$ phase for said alloy.

7. The process for producing an alloy as defined in claim 1, wherein said property of said alloy is a measure of a stacking fault energy for said alloy.

8. The process for producing an alloy as defined in claim 1, wherein said bond order (Bo) is taken along said first axis and said property said alloy taken along said second axis is at least one alloying element.

9. A process for producing an alloy having a mother metal and at least one alloying element (1), . . . (i) and having a phase stability being free from the precipitation of second phases which deteriorate alloy properties which comprises:

calculating average values $\overline{Md}$ and $\overline{Bo}$ of an alloy according to the following formulae:

$$\overline{Md} = \sum_{k=1}^{i} Xk\,(Md)k \quad (1)$$

$$\overline{Bo} = \sum_{k=1}^{i} Xk\,(Bo)k \quad (2)$$

where Xk is an atomic fraction of an alloying element (k), wherein (Md)k is an energy level of "d" orbitals of said alloying element (k), (Bo)k is a bond order between a mother metal and said alloying element (Bo)k, and K is 1, 2, . . . , i;

preparing an alloy phase stability index diagram of said alloy with known composition of said mother metal and said alloying elements (1), . . . (i), said diagram having two axes corresponding to an ordinate and an abscissa in which said $\overline{Bo}$ thus defined is taken along a first axis and said $\overline{Md}$ thus defined is taken along a second axis; and preparing said alloy having such amounts of said alloying elements as determined from said alloy phase stability index diagram.

10. The process for producing an alloy as defined in claim 9, wherein said alloy is selected from the group consisting of a Ni-based alloy, a Co-based alloy, and a Fe-based alloy.

11. The process for producing an alloy as defined in claim 9, wherein said alloy is a multi-component system having said mother metal and at least two said alloying elements.

12. The process for producing an alloy as defined in claim 9, wherein said alloy is a titanium (Ti) based alloy.

13. A process for controlling the quality of an alloy having a mother metal and at least one alloying element (1), . . . (i) and having a phase stability being free from the precipitation of second phases which deteriorate alloy properties which comprises:

calculating an average value $\overline{Bo}$ of an alloy according to the following formula:

$$\overline{Bo} = \sum_{k=1}^{i} Xk\,(Bo)k \quad (2)$$

where Xk is an atomic fraction of an alloying element (k), (Bo)k is a bond order between a mother metal and said alloying element (Bo)k, and k is 1, 2, . . . , i;

preparing an alloy phase stability index diagram of said alloy with known compositions of said mother metal and said alloying elements (1), . . . (i), said diagram having two axes corresponding to an ordinate and an abscissa in which said $\overline{Bo}$ thus defined is taken along a first axis and a property of said alloy is taken along a second axis; and controlling the quality of said alloy having said mother metal and alloying elements with reference to said alloy phase stability index diagram.

14. The process for controlling the quality of an alloy as defined in claim 13, wherein said alloy is selected from the group consisting of a Ni-based alloy, a Co-based alloy, and a Fe-based alloy.

15. The process for controlling the quality of an alloy as defined in claim 13, wherein said alloy is a multi-component system having said mother metal and at least two said alloying elements.

16. The process for controlling the quality of an alloy as defined in claim 13, wherein said alloy is a Fe-Ni-Cr system.

17. The process for controlling the quality of an alloy as defined in claim 13, wherein said alloy is a Ni-based single crystal superalloy.

18. The process for controlling the quality of an alloy as defined in claim 13, wherein said property of said alloy is a measure of a brittle TCP $\sigma$ phase for said alloy.

19. The process for controlling the quality of an alloy as defined in claim 13, wherein said property of said alloy is a measure of a stacking fault energy for said alloy.

20. The process for controlling the quality of an alloy as defined in claim 13, wherein said bond order (Bo) is taken along said first axis and said property of said alloy taken along said second axis is at least on alloying element.

21. A process for controlling the quality of an alloy having a mother metal and at least one alloying element (1), . . . (i) and having a phase stability being free from the precipitation of second phases which deteriorate alloy properties which comprises:

calculating average values $\overline{Md}$ and $\overline{Bo}$ of an alloy according to the following formulae:

$$\overline{Md} = \sum_{k=1}^{i} Xk\,(Md)k \quad (1)$$

$$\overline{Bo} = \sum_{k=1}^{i} Xk\,(Bo)k \quad (2)$$

wherein Xk is an atomic fraction of an alloying element (k), wherein (Md)k is an energy level of "d" orbitals of said alloying element (k), (Bo)k is a bond order between a mother metal and said alloying element (Bo)k, and k is 1, 2, . . . , i;

preparing an alloy phase stability index diagram of said alloy with known compositions of said mother metal and said alloying elements (1), . . . (i), said diagram having two axes corresponding to an ordinate and an abscissa in which said $\overline{Bo}$ thus defined is taken along a first axis and said $\overline{Md}$ thus defined is taken along a second axis; and preparing said alloy having such amounts of said alloying elements as determined from said alloy phase stability index diagram.

22. the process for controlling the quality of an alloy as defined in claim 21, wherein said alloy is selected from the group consisting of a Ni-based alloy, a Co-based alloy, and a Fe-based alloy.

23. The process for controlling the quality of an alloy as defined in claim 21, wherein said alloy is a multicomponent system having said mother metal and at least two said alloying elements.

24. The process for producing an alloy as defined in claim 1, which further comprises calculating an average value $\overline{Md}$ according to the following formula:

$$\overline{Md} = \sum_{k=1}^{i} Xk\,(Md)k \quad (1)$$

and using said value $\overline{Md}$ in preparing said alloy phase stability index diagram.

25. A process for producing a Ni-based single crystal superalloy having a mother metal and at least one alloying element (1), . . . (i) and having a phase stability being free from the precipitation of second phases which deteriorate alloy properties which comprises:

calculating an average value Md of an alloy according to the following formula:

$$\overline{Md} = \sum_{k=1}^{i} Xk\,(Md)k \quad (1)$$

wherein Xk is an atomic fraction of an alloying element (k), wherein (Md)k is an energy level of "d" orbitals of said alloying element (k), and K is 1, 2, . . . , i;

preparing an alloy phase stability index diagram of said alloy with known compositions of said mother metal and said alloying elements (1), . . . (i), said diagram having two axes corresponding to an ordinate and an abscissa in which said $\overline{Md}$ thus defined is taken along a first axis and a property of said alloy is taken along a second axis; and preparing said alloy having such amounts of said alloying elements as determined from said alloy phase stability index diagram.

* * * * *